US005899624A

United States Patent [19]

Thompson

[11] Patent Number: 5,899,624

[45] Date of Patent: May 4, 1999

[54] FLUID DISPENSING VALVE

[76] Inventor: Edwin Thompson, 9 N. Cole St., Spring Valley, N.Y. 10977

[21] Appl. No.: 08/925,450

[22] Filed: Sep. 8, 1997

[51] Int. Cl.[6] ..... B43K 5/00

[52] U.S. Cl. ..... 401/206; 401/196

[58] Field of Search ..... 401/206, 205, 401/196, 202

[56] References Cited

U.S. PATENT DOCUMENTS

| | | | |
|---|---|---|---|
| 2,118,051 | 5/1938 | MacMichael . | |
| 3,084,375 | 4/1963 | Schwartzman . | |
| 3,169,267 | 2/1965 | Luedtke . | |
| 3,256,551 | 6/1966 | Schwartzman . | |
| 3,340,561 | 9/1967 | Schwartzman . | |
| 3,349,966 | 10/1967 | Schwartzman . | |
| 3,481,678 | 12/1969 | Schwartzman . | |
| 3,570,396 | 3/1971 | Schwartzman . | |
| 3,601,287 | 8/1971 | Schwartzman . | |
| 3,655,779 | 4/1972 | Scwartzman | 401/206 |
| 3,663,113 | 5/1972 | Frain et al. . | |
| 4,133,614 | 1/1979 | Baginski et al. . | |
| 4,480,940 | 11/1984 | Woodruff . | |
| 4,541,552 | 9/1985 | Scheithauer . | |
| 4,569,612 | 2/1986 | Schwartzman et al. . | |
| 4,620,648 | 11/1986 | Schwartzman . | |
| 4,693,623 | 9/1987 | Schwartzman . | |
| 4,762,433 | 8/1988 | Bergeson et al. | 401/206 |
| 4,795,156 | 1/1989 | Paulish . | |
| 4,863,171 | 9/1989 | Rocheleau . | |
| 5,199,808 | 4/1993 | Gueret . | |
| 5,568,990 | 10/1996 | McAuley . | |

*Primary Examiner*—David J. Walczak
*Attorney, Agent, or Firm*—Arthur L. Plevy

[57] ABSTRACT

A fluid dispensing valve used for printing and marking, having a valve body with an end wall which defines an aperture and a spring biased valve element disposed within the valve body to open and close the aperture. A spring element is coupled to the tubular body adjacent the circular wall, the spring element and the wall defining a chamber for receiving a fluid metered through the aperture of the valve body when the aperture is opened, the spring element having at least one aperture communicating with the chamber. A porous member is affixed to the spring element such that the porous member covers the aperture in the spring element. The porous member transfers the fluid received in the chamber to a surface in the form of a printed geometric image. In operation, a printing force applied to the porous member causes the spring element to compress and engage the portion of the valve element thereby pushing a portion of the valve element partially back through the aperture in the open position to allow the passage of a marking fluid therethrough to the chamber to wet the porous member. The porous member has a predetermined rigidity which substantially prevents the porous member from distorting from its predetermined geometric shape under the printing force. The fluid dispensing valve is typically affixed to the open end of a container which contains the fluid to be dispensed. A removable cap is provided for covering the valve when it is not being used.

16 Claims, 4 Drawing Sheets

FLUID DISPENSING VALVE

FIELD OF THE INVENTION

The present invention relates to fluid dispensing and more particularly to a fluid dispensing valve for a squeeze tube or like receptacle containing a fluid such as ink, the fluid dispensing valve being used for marking various types of items such as bingo cards and the like.

BACKGROUND OF THE INVENTION

Devices for dispensing various fluids are well known in the art and generally comprise a container which holds the fluid to be dispensed, and a flow control or dispensing valve arrangement for metering the fluid from the container. Many of these devices are used for applying liquid products to surface areas of various articles and even the human body. For example, such dispensing devices are commonly used for applying medicaments, deodorants, cleaning fluids, pre-wash laundry products, polishes, inks, paints, etc.

The fluid dispensing valves of these devices generally include a tubular valve body and a valve arrangement, these parts being typically resiliently positioned relative to one another to prevent flow of the fluid from the container and arranged so that the valve member may be moved relative the valve body, by the application of an exterior force, to an open or unsealed position to permit the flow of the fluid from the container. The opening force is usually applied so that when the valve body is unsealed, the fluid flows by gravity onto the surface of the object, via some type of porous rubbing applicator pad located over the dispensing valve.

Somewhat recently, the use of such dispensing devices has been extended to the marking of bingo cards. In particular, U.S. Pat. No. 4,795,156 to Paulish describes a fluid dispensing device referred to therein as a square bingo dobber, that utilizes an internal square porous applicator to impart a transparent color, such as yellow, to a central portion of a bingo square to be marked. A perimeter square ring applying an opaque coloration, frames the central square pad to highlight the central coloration and demarcate the particular square from surrounding ones. A central reservoir provides coloring fluid to the central square dobber portion and a surrounding reservoir provides fluid to the aforementioned ring-like dobber portion.

Another fluid dispensing device used for marking bingo cards is described in U.S. Pat. No. 4,863,171, to Rocheleau. In this patent, a bingo dabber having a hollow head portion and a hollow handle portion providing the overall appearance of a hammer, is disclosed. The head portion has a ink dispensing valve-operated applicator at each end, the applicators preferably being of different diameters. The head and handle portions are filled with a colored, indelible, transparent ink. During use, the bingo player applies the desired applicator to the desired location by using a smooth, soft hammer-like motion while gripping the handle portion of the dabber.

A problem associated with virtually all of these fluid dispensing devices used for marking or printing, especially the fluid dispensing devices used for marking bingo cards, is that they tend to print images which have very low resolution. This is because these prior art fluid dispensing devices employ the ink dispensing valves which meter too much liquid to the overlying fluid transfer pad.

Accordingly, it should be appreciated that there is a continuing need for an improved ink dispensing valve for use in marking bingo cards and other items.

SUMMARY

A fluid dispensing valve, comprising check-valve means for metering a fluid, a spring element coupled to the check-valve means, and porous means of a predetermined geometric shape, affixed to the spring element for transferring the fluid to a surface. The spring element and the check-valve means define a chamber therebetween for receiving the fluid metered by the check-valve means. In operation, a force applied to the porous means causes the spring element to compress, thereby opening the check-valve means to allow the passage of the fluid therethrough to the chamber to wet the porous means, the porous means having a predetermined rigidity which substantially prevents the porous means from distorting from the predetermined geometric shape under the applied force.

BRIEF DESCRIPTION OF THE DRAWINGS

For the purpose of illustrating the present invention, reference should be made to the following drawings wherein.

DETAILED DESCRIPTION OF THE INVENTION

Figure 1:
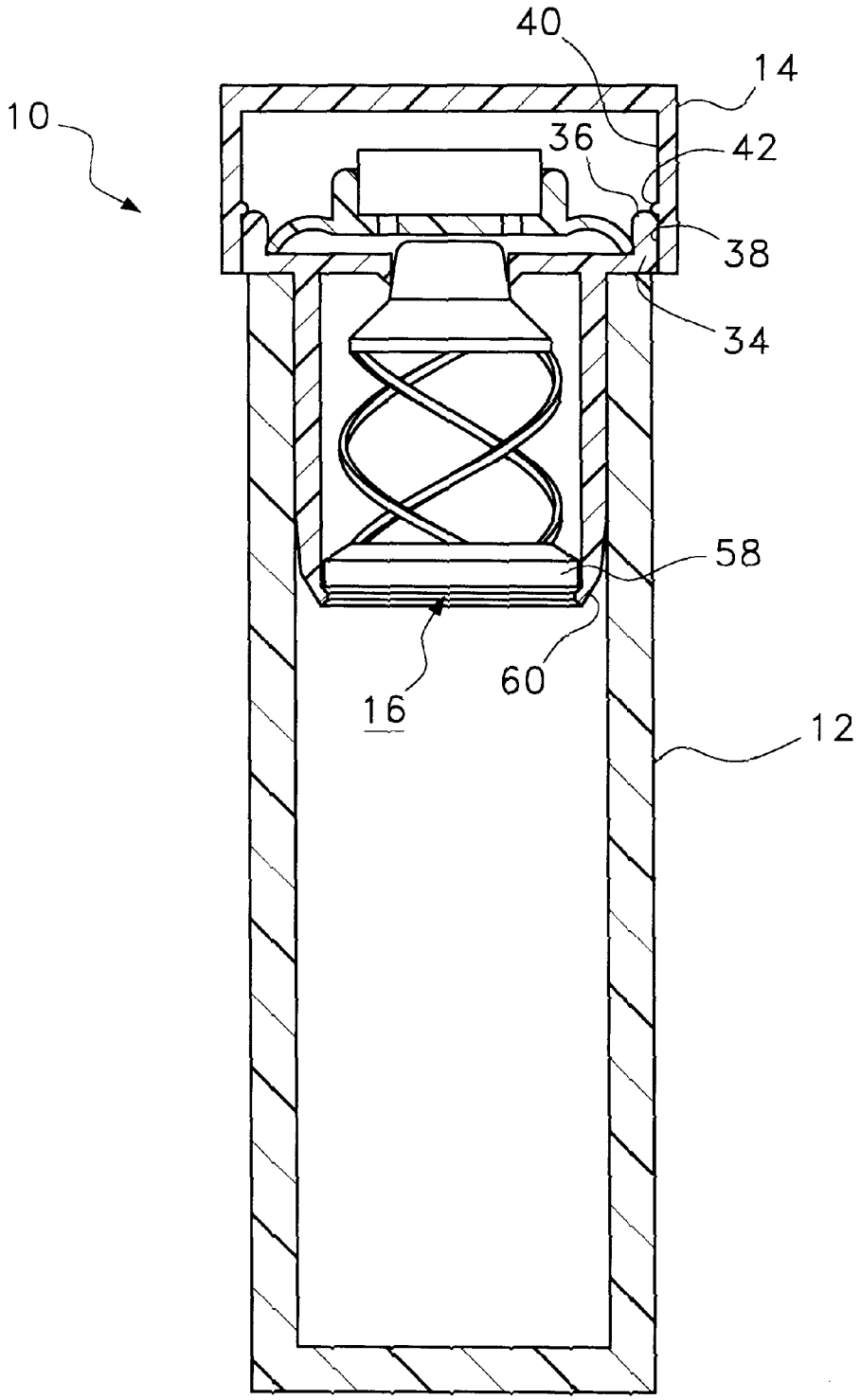
FIG. 1 is an elevational view of an ink dispensing valve according to the present invention affixed to a squeeze tube or like container.

Referring to FIG. 1, there is shown a fluid dispensing device 10 employing a fluid dispensing valve 16 embodying the features of the present invention, a fluid container 12 and a cap 14 which may be of the slip-on or screw-on type and fabricated of plastic, for example. The fluid dispensing valve 16 is positioned by friction fit or by some type of adhesive or like bonding method, in the opening at the upper end of the container 12, as shown.

Figure 2:
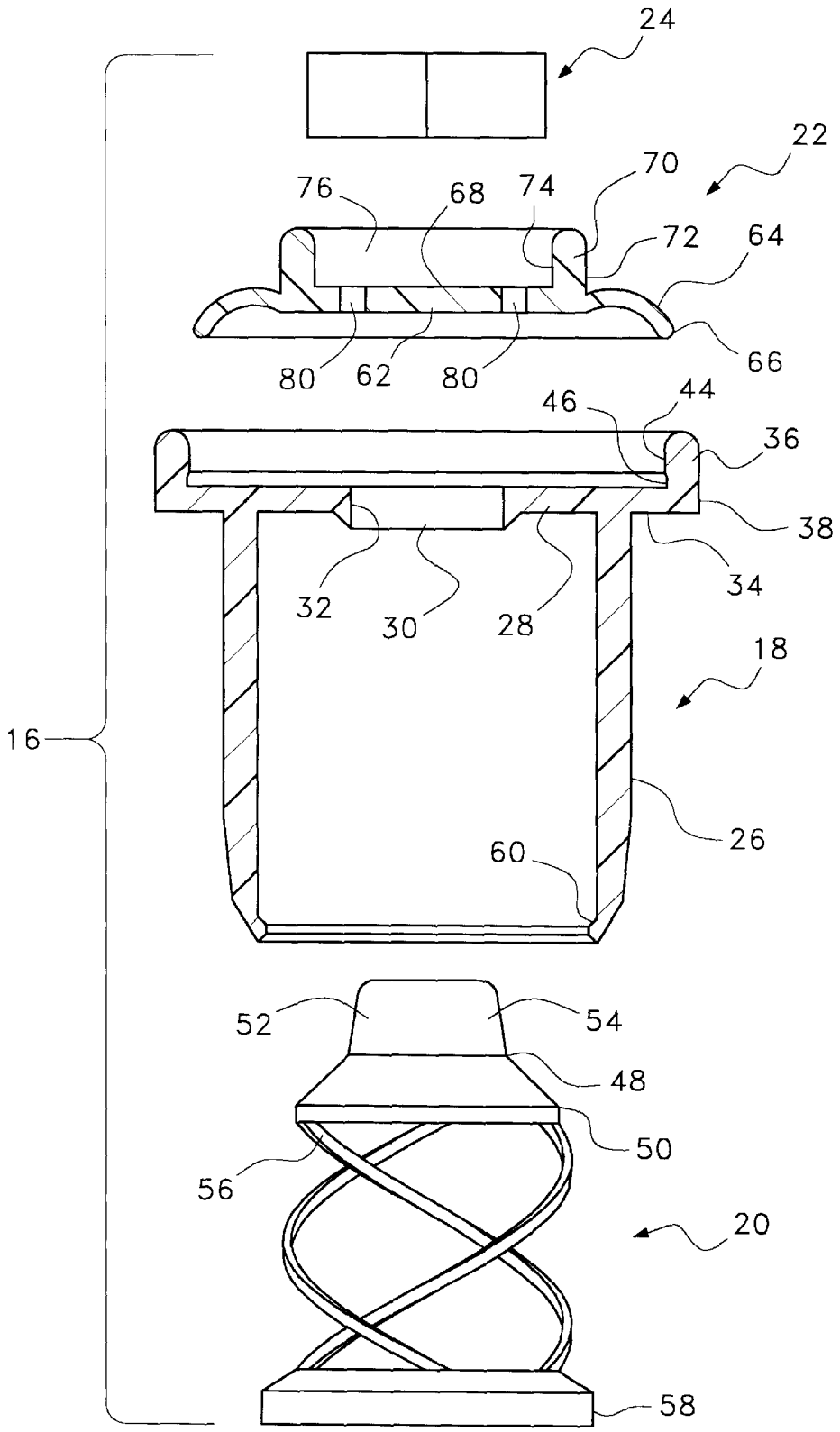
FIG. 2 is an exploded partial cross sectional view of the ink dispensing valve.

FIG. 2 illustrates all the components of the fluid dispensing valve 16. The valve 16 generally comprises a valve body 18, a unitarily formed valve and spring assembly 20, a disk spring 22, and a fluid transfer pad 24. The valve body 18 is fabricated of a semi-rigid resilient material such as polyethylene, and includes a tubular member 26 which extends from an end wall 28 having a central aperture 30 defined by a cylindrical valve seat surface 32. An annular flange 34 extends beyond the tubular member 26, the annular flange 34 being bounded by a lip 36 whose outer peripheral surface 38 seals against the inner surface 40 of the cap 14 and an annular sealing bead 42 defined on the inner surface 40 of the cap 14 (FIG. 1) and whose inner peripheral surface 44 defines a continuous groove 46.

The valve and spring assembly 20 includes a valve element 48 having a base 50 formed that merges with a centrally disposed upstanding tapered stem 54 having an upwardly converging conical seating surface 52. As shown in FIGS. 1, 4A, 4B, and 5, the tapered stem 54 is adapted to extend through the aperture 30 in the end wall 28. The valve element 48 is axially movable within the tubular member 26, as will be more fully described, and selectively closes off the aperture 30 in the end wall 28.

The valve and spring assembly 20 further includes a compression spring 56 positioned below the base 50 of the valve element 48. The compression spring 56 includes a circular spring retainer 58 which abuts against an inwardly directed shoulder 60 at the terminal end of the tubular member to urge the valve element 48 towards the end wall 28 when the valve 16 is assembled. It is preferred to unitarily form the spring and valve element 20 of a semi-rigid resilient material such as polyethylene which is inherently characterized by the resilience necessary for the spring 56 and which is non-reactant with the intended contents of the container 12 to be dispensed.

The disk spring 22 has a substantially rigid circular central planar member 62 surrounded by an annular skirt 64 having an arcuate cross-section which is substantially thinner than the cross-section of the central planar member 62. This construction allows the annular skirt 64 to function as a spring thereby enabling the central planar member 62 to move axially relative to the peripheral edge 66 of the annular skirt 64 when a force is applied to the central planar member 62 as will be explained further on. The peripheral edge 66 of the annular skirt 64 has a generally circular cross-section which enables the peripheral edge 66 to form a fluid tight seal with the groove 46 on the inner surface 44 of the lip 36.

Still referring to the disk spring 22, the upper surface 68 of the central planar member 62 is bounded by an upstanding flange 70 that defines a cylindrical outer surface 72 and in a preferred embodiment, a heart-shaped inner surface 74 that defines a heart-shaped recess 76 for receiving a heart-shaped version of the fluid transfer pad 24. A plurality of apertures 80 extend through the central planar member 62 of the disk spring 22 to allow the transfer of fluid to the adjacent surface of the fluid transfer pad 24. Like the spring and valve element 20, the disk spring 22 is formed of a semi-rigid resilient material such as polyethylene which is inherently characterized by the resilience necessary for the annular skirt 64.

Figure 3:
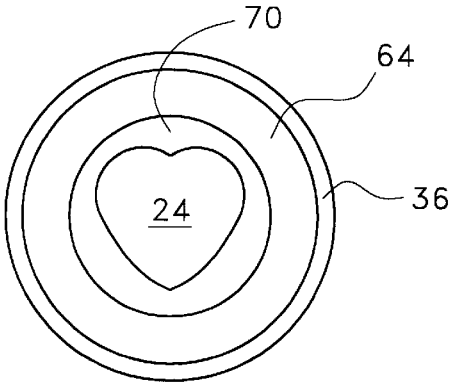
FIG. 3 is a top plan view of the ink dispensing valve.

The fluid transfer pad 24 is made from any sufficiently rigid porous material which is capable of printing a crisp, high resolution image without physically distorting from the printing pressure, while allowing a flow rate of fluid that causes the pad 24 to be just moist enough to print without bleeding the image. Such materials include felt, rubber, cork, foam, suitable polymeric materials, and the like. The fluid transfer pad 24 resides in the recess 76 defined by the central planar member 62 and the upstanding flange 70, and is glued or otherwised bonded to the central planar member 62 to retain the pad 24 in the recess 76. As mentioned earlier, in the preferred embodiment, the fluid transfer pad 24 is heart-shaped as shown in FIG. 3. It should be understood, however, that the fluid transfer pad 24 can be formed in any desirable shape depending on the image to be printed.

Figure 4A:
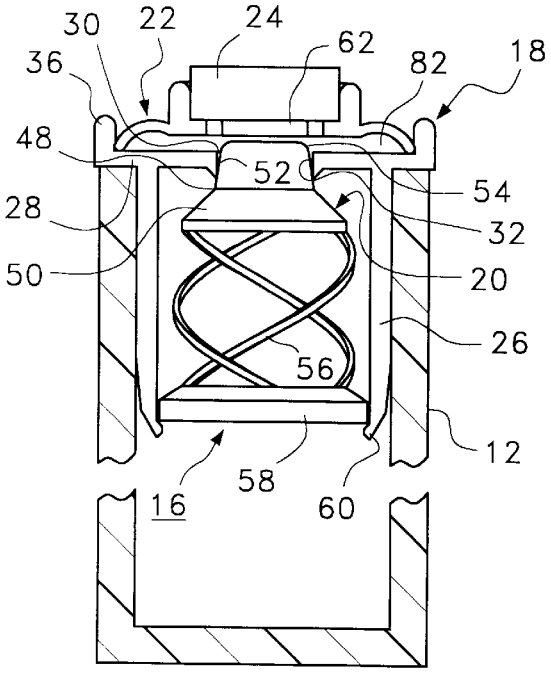
FIG. 4A is a partial cross sectional view illustrating the ink dispensing valve in the closed or sealed position for storage.

In assembling the fluid dispensing valve 16 into a sealed or closed position as shown in FIG. 4A, the unitary valve element and spring 20 are inserted into the opening of the tubular member 26, with the spring retainer 58 snap fitting against the shoulder 60, and the stem 54 of the valve element 48 projecting through the aperture 30 of the valve body 18. The base 50 of the valve element 48 is forced upwardly so that the conical seating surface 52 engages the valve seat surface 32 of the aperture 30. Because of the inherent resilience of the material involved, the mating surfaces will complement one another and afford a seal which prevents the fluid contents of the container 12 from flowing out through the aperture 30 in the end wall 28 of the valve body 18.

The disk spring 22 is inserted into the opening defined by the lip 36, the peripheral edge 66 of the annular skirt 64 snapping into the groove 46 defined on the inner surface 44 of the lip 36 to form a substantially fluid tight seal chamber 82 between the disk spring 22 and the end wall 28 of the valve body 18. The central planar portion 62 is forced upwardly thereby allowing the stem 54 of the valve element 48 to freely project through the aperture 30 to maintain contact between the conical seating surface 52 and the valve seat surface 32 of the aperture 30.

Figure 4B:
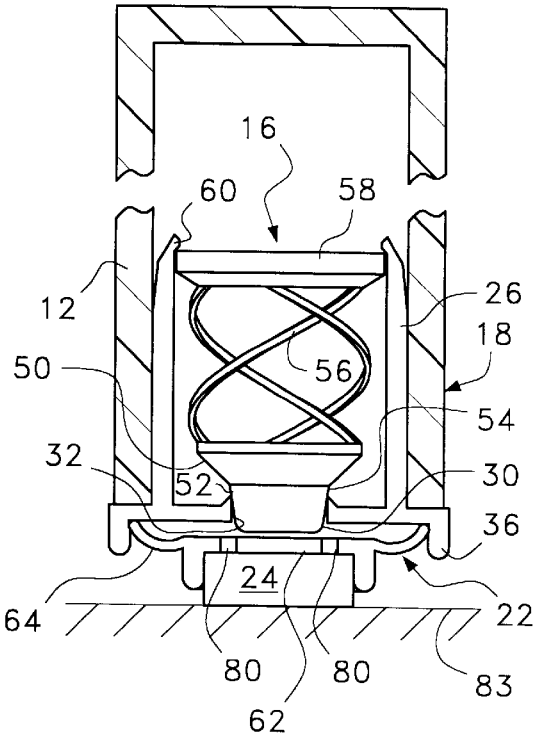
FIG. 4B is similar to FIG. 4A but shows the ink dispensing valve in open or unsealed position for printing and marking.

In use, the fluid dispensing valve 16 is inverted as shown in FIG. 4B and pressed against any surface 83 which compresses the disk spring 22 and causes the central planar member 62 to move axially and contact the stem 54 of the valve element 48. The axial movement of the central planar member 62 forces the stem 54 partially through of the aperture 30 to break the primary seal and permit the flow of fluid by gravity from the container 12, through the tubular member 26 and the aperture 30, around the stem 54, through the apertures 80 in the central planar member 62 and into the fluid transfer pad 24. Upon release of the pressure, the annular skirt 64 of the disk spring 22 urges the central planar member 62 axially away from the stem 54 thereby allowing the spring 56 to urge the valve element 48 towards the end wall 28 so that the conical seat engaging surface 52 engages the seat surface 32 of the aperture 30 to close the dispensing valve 16.

Figure 5:
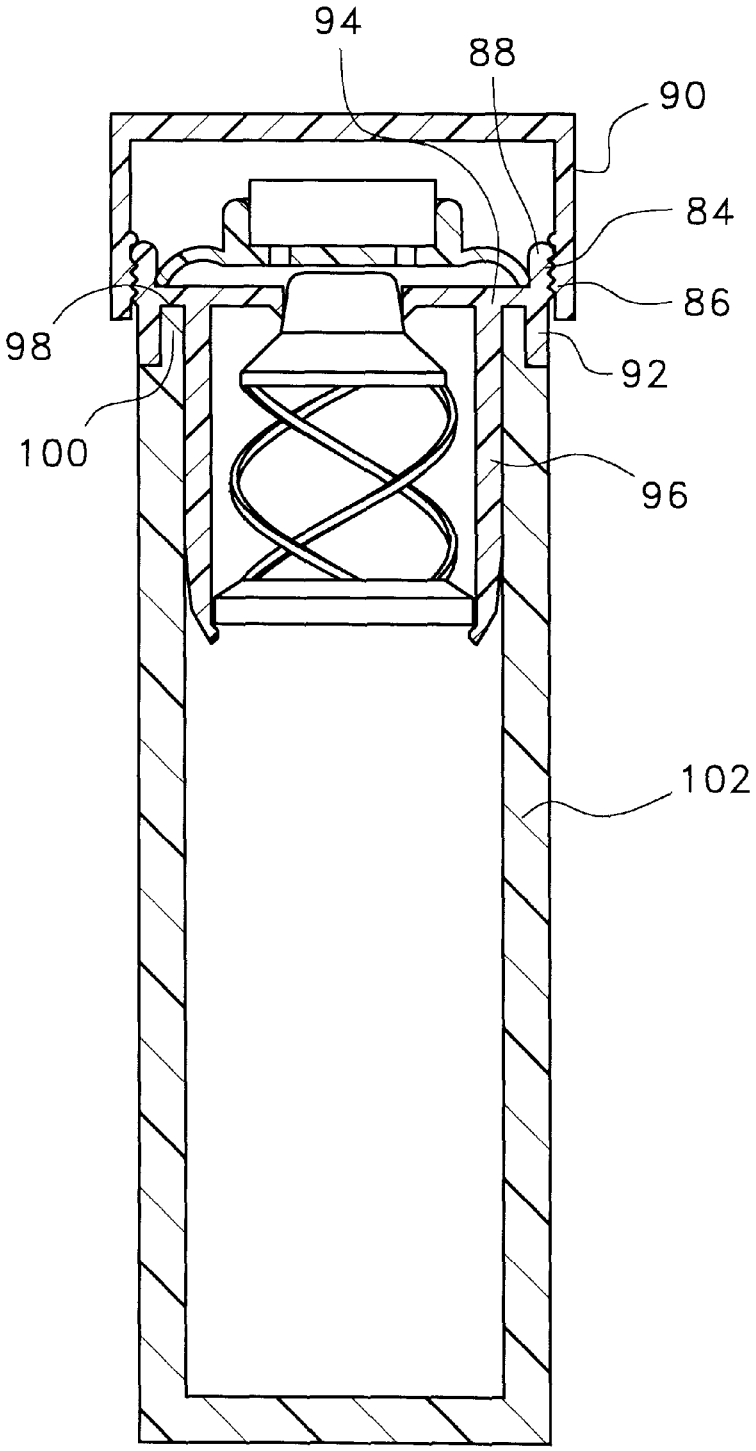
FIG. 5 is an elevational view of a second embodiment of the ink dispensing valve of the present invention affixed to a squeeze tube or like container.

In the embodiment shown in FIG. 1, the cap 14 frictionally engages the valve body 18 on the outer surface 38 of the lip 36. In a second embodiment of the invention as depicted in FIG. 5, a screw thread 84 or like structure is provided on the outer surface of the lip 88 which mates with a screw thread 86 or like structure defined on the inner surface of the cap 90 for enabling the cap 90 to be screw-threaded to the valve. Further, a second lip 92 extends from the annular flange 94 in the direction of the tubular member 96 to form an annular groove 98 therebetween for sealingly receiving an upstanding flange 100 on the rim surface of the container 102.

It will be understood that the embodiment described herein is merely exemplary and that a person skilled in the art may make many variations and modifications to the described embodiment utilizing functionally equivalent elements to those described. Any variations or modifications to the invention described hereinabove are intended to be included within the scope of the invention as defined by the appended claims.

What is claimed is:

1. A fluid dispensing valve, comprising:

a valve body including an end wall which defines an aperture extending therethrough, and an annular flange extending from a surface of said end wall, said annular flange having an inner groove;

check-valve means disposed in said valve body for metering a fluid, said check-valve means including a portion which cooperates with said aperture for a liquid tight seal in a closed position;

a spring element including at least one aperture extending therethrough and a flexible annular skirt, said flexible annular skirt being coupled to said inner groove of said annular flange, said spring element and said surface of said end wall defining a chamber therebetween for receiving the fluid metered by the check-valve means; and porous means of a predetermined geometric shape, affixed to said spring element for transferring the fluid received in said chamber to a surface;

wherein a force applied to said porous means causes said spring element to compress, thereby engaging and pushing said portion of said check-valve means through said aperture, whereby in an open position fluid passes therethrough to said chamber and through said at least one aperture to wet said porous means, said porous means having a predetermined rigidity which substantially prevents-said porous means from distorting from said predetermined geometric shape under the applied force.

2. The fluid dispensing valve according to claim 1, wherein the force applied to said porous means is a printing force which causes said porous means to transfer the fluid to the surface in the form of a printed geometric image.

3. The fluid dispensing valve of claim 1, wherein said spring element is disk-shaped and substantially planar.

4. The fluid dispensing valve of claim 1, wherein said predetermined geometric shape comprises a heart.

5. The fluid dispensing valve of claim 1, wherein said check valve means further includes a spring biased valve element disposed within said valve body, said spring biased valve element having a portion which extends through said aperture to provide a liquid tight seal thereat in a closed position.

6. A fluid dispensing valve used for printing and marking, comprising:

a valve body having an end wall which defines an aperture, and a tubular member extending from a first surface of said end wall;

a spring biased valve element disposed within said tubular member, said spring biased valve element having a portion which extends through said aperture to provide a liquid tight seal thereat in a closed position;

a spring element coupled to said valve body adjacent a second surface of said end wall, said spring element and said second surface of said end wall defining a chamber for receiving a fluid metered through said aperture of said valve body when said portion of said valve element is moved partially back through said aperture in an opened position, said spring element having at least one aperture communicating with said chamber; and porous means having a predetermined geometric shape affixed to said spring element such that said porous means covers said at least one aperture in said spring element, said porous means for transferring the fluid received in the chamber to a surface in the form of a printed geometric image;

wherein a printing force applied to said porous means causes said spring element to compress and engage said portion of said valve element thereby pushing said portion partially back through said aperture in said open position to allow the passage of a marking fluid therethrough to said chamber to wet said porous means, said porous means having a predetermined rigidity which substantially prevents said porous means from distorting from said predetermined geometric shape under the printing force.

7. The fluid dispensing valve of claim 6, wherein said spring element is disk-shaped and substantially planar.

8. The fluid dispensing valve of claim 6, wherein said predetermined geometric shape comprises a heart.

9. The fluid dispensing valve of claim 6, wherein the fluid is an marking ink.

10. The fluid dispensing valve of claim 6, wherein said fluid dispensing valve is for printing geometric images on bingo cards.

11. A device for applying a fluid to a surface, comprising:

a container for holding a fluid, said container having an open end;

a valve body disposed in said open end of said container, said valve body including an end wall which defines an aperture and a flange extending from a first surface of said end wall, said flange having an inner groove;

check-valve means for metering said fluid, said check-valve means disposed in said valve body, said check-valve means including a portion which extends through said aperture to provide a liquid tight seal in a closed position;

a spring element coupled to said valve body adjacent a second surface of said end wall, said spring element and said second surface defining a chamber therebetween for receiving the fluid metered by the check-valve means; and porous means of a predetermined geometric shape affixed to said spring element for transferring the fluid received in said chamber to said surface, said spring element including means for allowing fluid communication between said chamber and said porous means;

wherein a force applied to said porous means causes said spring element to compress, thereby engaging and pushing said portion of said check-valve means partially through said aperture in an open position to allow the passage of the fluid therethrough to said chamber to wet said porous means, said porous means having a predetermined rigidity which substantially prevents said porous means from distorting from said predetermined geometric shape under the applied force.

12. The device according to claim 11, further comprising a removable cap for covering said porous means when said device is not being used.

13. The device according to claim 11, wherein said spring element is disk-shaped and substantially planar.

14. The device according to claim 11, wherein said predetermined geometric shape comprises a heart.

15. A The device according to claim 11, wherein the fluid is applied to the surface in the form of a printed geometric image.

16. The device according to claim 15, wherein said device is for printing geometric images on bingo cards.

* * * * *